United States Patent [19]

Carlin

[11] Patent Number: 4,901,665

[45] Date of Patent: Feb. 20, 1990

[54] LINE MARK BOOK MARK

[76] Inventor: Paul J. Carlin, 422 N. Austin, Oak Park, Ill. 60302

[21] Appl. No.: 277,969

[22] Filed: Nov. 30, 1988

[51] Int. Cl.[4] ..... B42D 9/00

[52] U.S. Cl. ..... 116/235; 116/240; 281/42

[58] Field of Search ..... 116/236, 235, 240, 234; 281/42

[56] References Cited

U.S. PATENT DOCUMENTS

| | | | |
|---|---|---|---|
| 1,232,116 | 7/1917 | Stechan | 116/236 |
| 1,420,265 | 6/1922 | Kieckhefer | 116/235 |
| 1,456,670 | 5/1923 | Brown | 281/42 |
| 1,966,340 | 7/1934 | Forbringer et al. | 116/235 |
| 2,108,494 | 2/1938 | Lansing | 116/235 |
| 3,266,456 | 8/1966 | O'Reilly | 116/235 |

FOREIGN PATENT DOCUMENTS

| | | | |
|---|---|---|---|
| 2485442 | 12/1981 | France | 116/235 |

*Primary Examiner*—William A. Cuchlinski, Jr.
*Assistant Examiner*—W. Morris Worth

[57] ABSTRACT

A book mark that locates an exact line, column, and page in an open book having two or one column pages. The bookmark body is encircled with a slide with an index line that can be moved vertically to align with any line of the text. Two sets of indicia are on the body. One set indicates the desired page, the other set indicates the desired column. In use, the body is first oriented so that the indicia indicating the desired page and column are at the upper portion of the right hand page. And then the slide is moved to indicate the line on that desired column and page.

1 Claim, 1 Drawing Sheet

LINE MARK BOOK MARK

Figure 1:
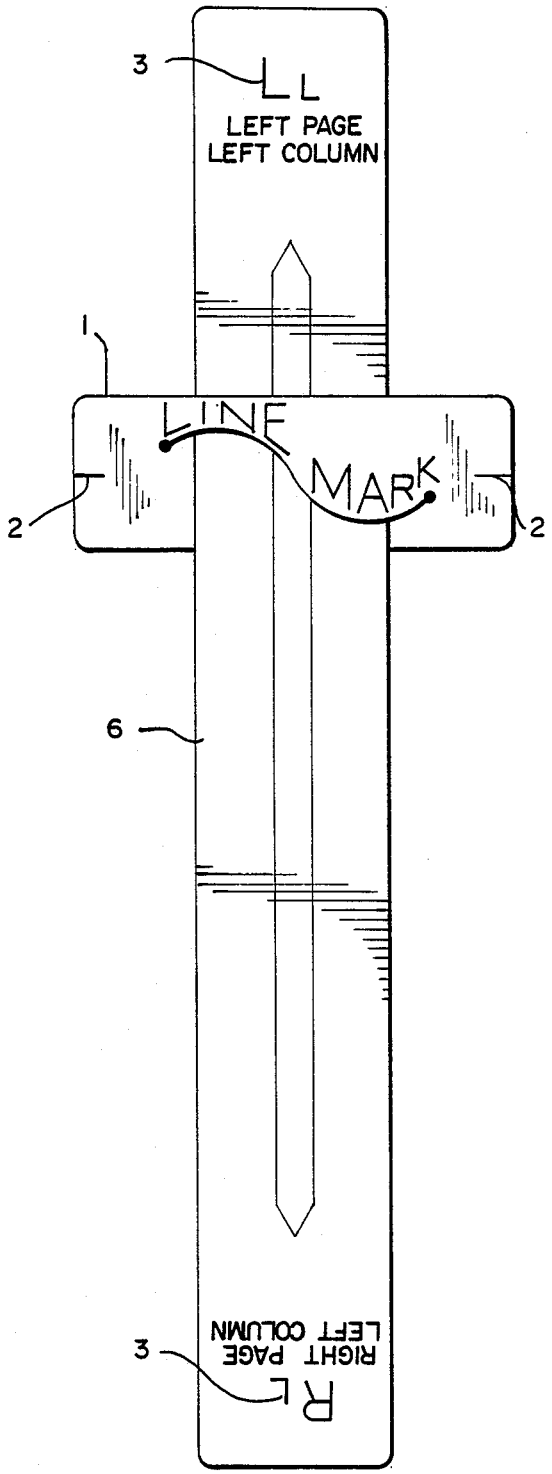

The present invention relates to bookmarks and more particularly to specialized bookmarks capable of returning a reader to the exact page, column and line desired.

Other objects, features, and advantages of the invention may be best understood by reference to the following detailed description taken in conjunction with the accompanying drawings in which like reference numerals indicate like parts and in which:

FIG. 1 is a plan view of one side of the device showing the encompassing slide 1 with index 2 and the indicator markings 3.

Figure 2:
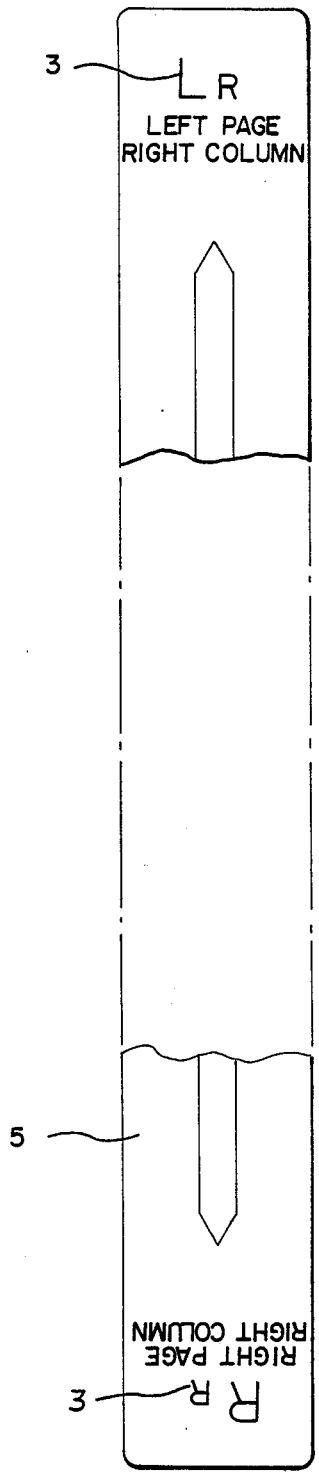

FIG. 2 is a plan view of the reverse side of the device.

Refering to FIG. 1. The slide 1 freely moves vertically on the body 6, the indicator markings 3 are arranged so that only one is viewed in an upright position when the device is lying flat upon the right page.

Refering to FIG. 2. What was described for FIG. 1 applies to this side equally.

OPERATION

The device according to the described embodiment is a two adjustment bookmark capable of marking a specific page, column, and line. Operation is accomplished by orienting the device upon the right page of an opened book with either the face 6 upward (for the left column upon a page) or the face 5 upward (for the right column upon a page), and orienting the device again to either an upright or upsidedown position for either the left or right pages, as indicated by the indicator markings 3, and finally positioning the device's lower edge collinear with the right page's lower edge, and moving the slide 1 vertically so that the index 2 points to the desired line.

In explanation of the two letter set of indicator markings 3, the large letter designates the page (L: left, R: right); the small letter designates the column upon that page (l: left, r: right), e.g. if Lr is upright, the direction is to the left page, right column.

It is to be understood that the described embodiments are merely illustrative of the invention. Numerous other arrangements may be devised by those skilled in the art without departing from the spirit and scope of the invention as defined by the apppended claims.

What is claimed is:

1. A bookmark for locating an exact line, column and page in a book having one or two columns of text on its pages comprising:

A thin flat elongated body for marking a place in the book of interest to a reader;

indicator means for indicating which page and column on that page in the book at the marked place is of interest to the reader, said indicator means being placed on top and bottom sections of both sides of said body and arranged such that only one set of indicia representing a page and column is viewable in an upright position on the side of the body facing the reader; and a manually operable slide slideably attached to said body, said slide being provided with index means viewable on both sides of said body for alignment with the line of interest to the reader at the indicated page and column of the marked place.

* * * * *